US005297801A

United States Patent [19]

Croker

[11] Patent Number: 5,297,801

[45] Date of Patent: Mar. 29, 1994

[54] SYNONYM AND ANTONYM QUESTION AND ANSWER BOARD GAME

[76] Inventor: John H. Croker, 7461-D Ohana Nui Cir., Honolulu, Hi. 96818

[21] Appl. No.: 952,596

[22] Filed: Sep. 28, 1992

[51] Int. Cl.[5] ..... A63F 3/00

[52] U.S. Cl. ..... 273/430; 273/272; 273/240; 434/167

[58] Field of Search ..... 273/243, 240, 258, 272, 273/302, 308, 429, 430, 431, 248, 249; 434/167, 170

[56] References Cited

U.S. PATENT DOCUMENTS 4,682,777 7/1987 Wood ..... 273/243
4,884,816 12/1989 Ford et al. ..... 273/240
4,889,344 12/1989 Zimba ..... 273/272 X
4,998,735 3/1991 Blackwell ..... 273/308 X
5,120,066 6/1992 Cohen ..... 273/258

*Primary Examiner*—Vincent Millin
*Assistant Examiner*—William M. Pierce
*Attorney, Agent, or Firm*—Michael I. Kroll

[57] ABSTRACT

A home word bound board game is provided which consists of game boards, game pieces, decks of game cards and game sheets. The object of the game is for each player to score with game pieces on the respective game board, as many points possible by guessing words on the game cards, using synonyms and antonyms listed on the game cards. The first player after three rounds having the highest point score listed on the game sheet wins the game.

13 Claims, 3 Drawing Sheets

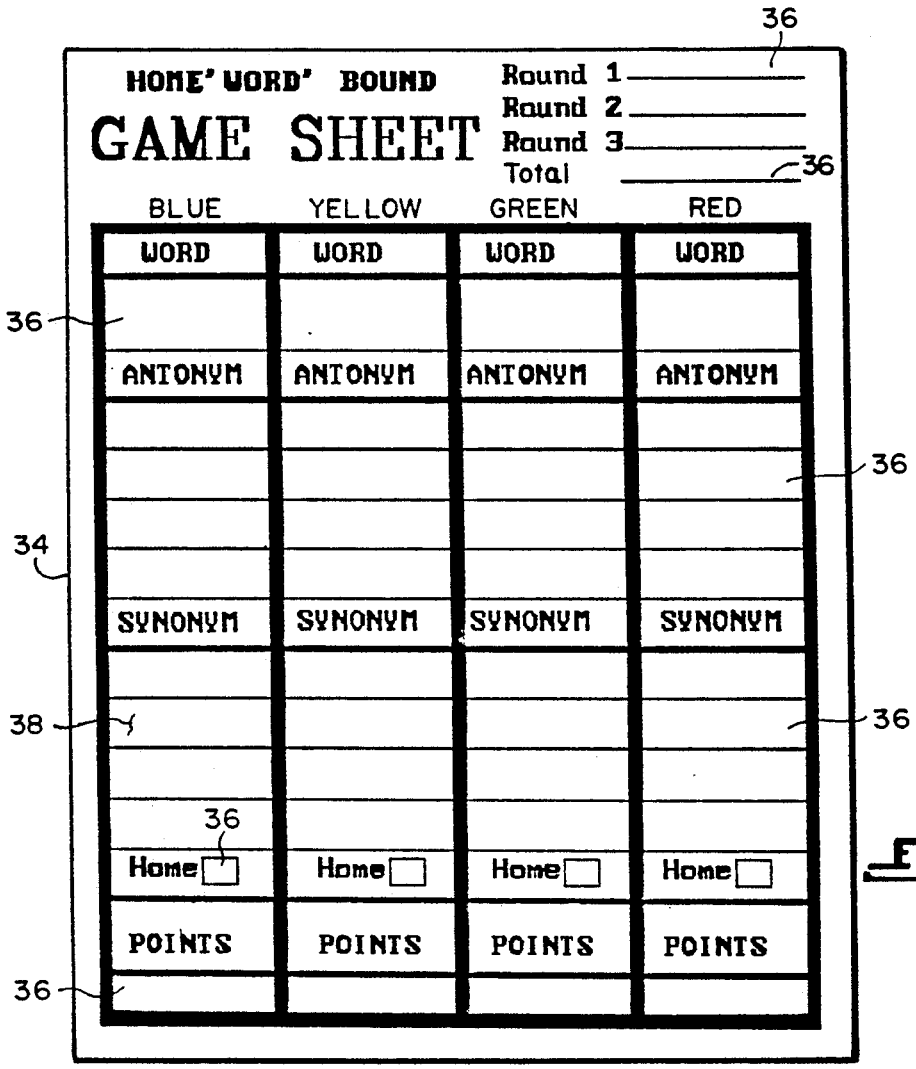
Fig. 2
Home'Word' Bound
26
Fig. 3
Fig. 4
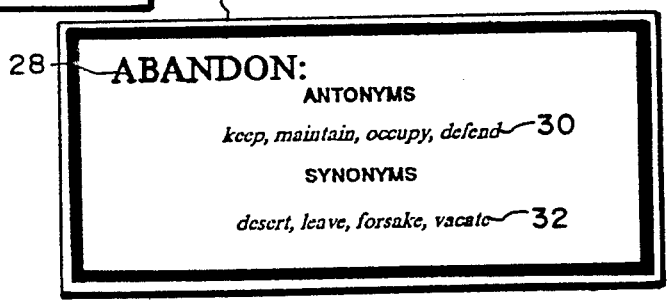

SYNONYM AND ANTONYM QUESTION AND ANSWER BOARD GAME

BACKGROUND OF THE INVENTION

1. Field of the Invention

The instant invention relates generally to board games and more specifically it relates to a home word bound board game.

DESCRIPTION OF THE PRIOR ART

Numerous board games have been provided in prior art that are adapted to contain learning instructions, such as questions and answers on various subject matters and have very little opportunity for chance, skill and other enjoyments of the game. While these units may be suitable for the particular purpose to which they address, they would not be as suitable for the purposes of the present invention as heretofore described.

SUMMARY OF THE INVENTION

A primary object of the present invention is to provide a home word bound board game that will overcome the shortcomings of the prior art devices.

Another object is to provide a home word bound board game that gives educational benefits as well as chance and skill to each player playing the game.

An additional object is to provide a home word bound board game that will entertain and increase word knowledge to each player to score as many points as possible by guessing words using synonyms and antonyms.

A further object is to provide a home word bound board game that is simple and easy to use.

A still further object is to provide a home word bound board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 2 is an enlarged plan view of one of the game sheets shown in FIG. 1A.

FIG. 3 is an enlarged plan view of the back of one of the game cards shown in FIG. 1A.

FIG. 4 is an enlarged plan view of the front of one of the game cards shown in FIG. 1A.

DETAILED DESCRIPTION OF THE PREFERRED EMBODIMENTS

Figure 1:
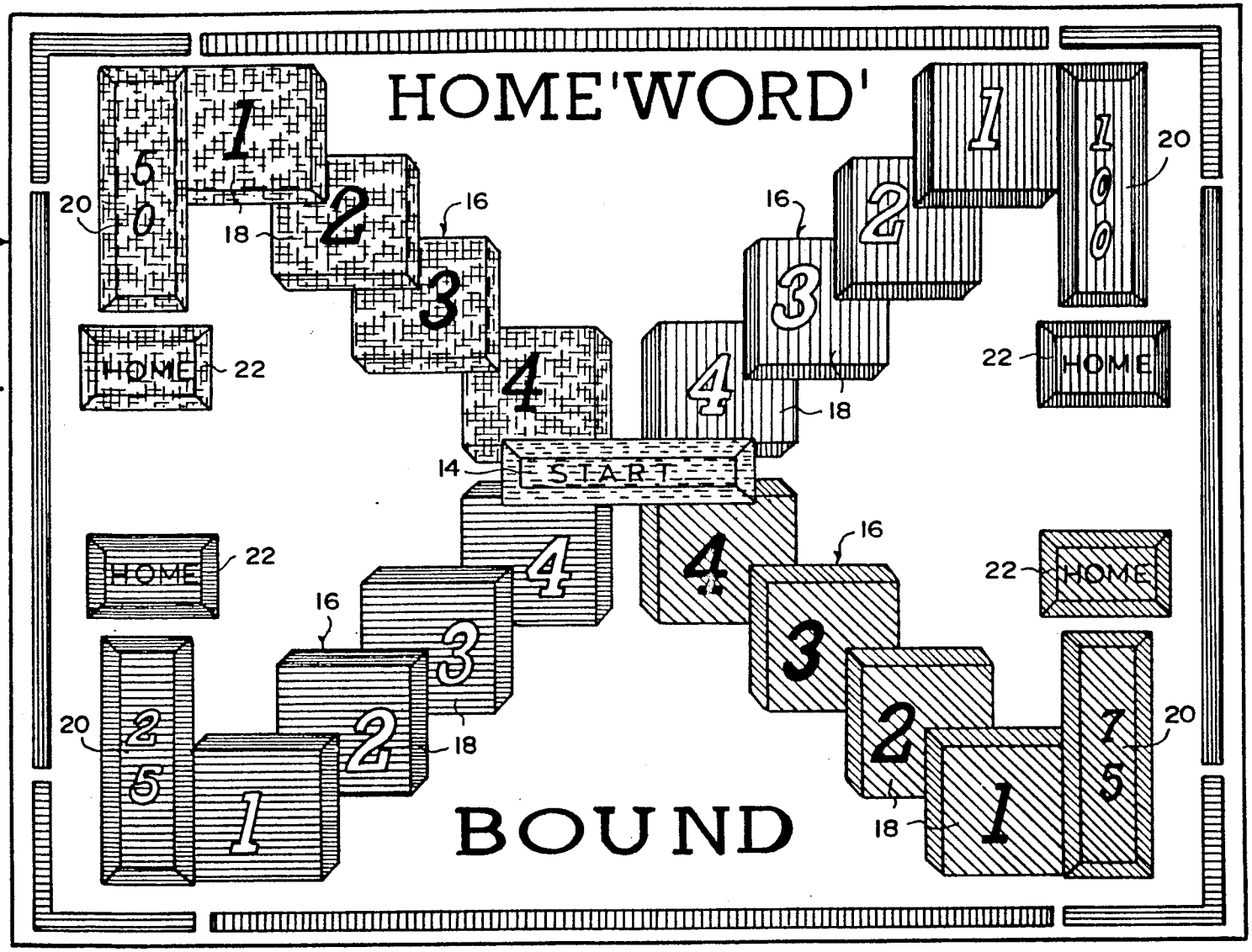
FIG. 1 is an enlarged plan view of one of the game boards shown in FIG. 1A.
Figure 1A:
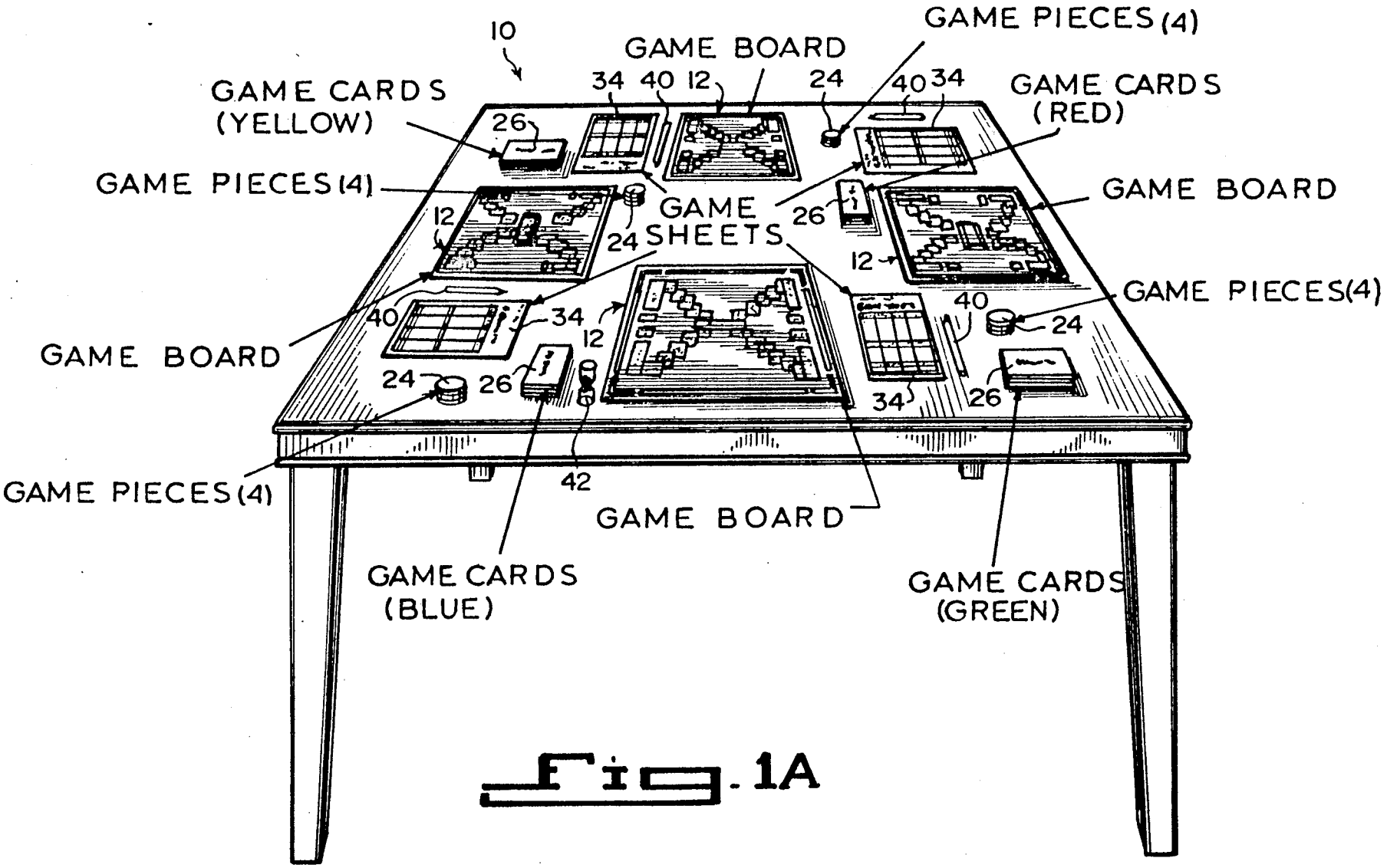
FIG. 1A is a perspective view of the various elements of the instant invention on a table ready to be played.

Turning now descriptively to the drawings, in which similar reference characters denote similar elements throughout the several views, the Figures illustrate a home word bound board game 10, which consists of a plurality of game boards 12, one for each of the game players. Each game board 12 has a center start space 14 with a plurality of paths 16 extending from the center start space 14. Each path 16 is uniquely identifiable from the others and has a plurality of descending consecutive numbered spaces 18 from the center start space 14, a spaces 20 having a number value for the respective path 16 and a home space 22.

The home word bound board game 10 further contains a plurality of game pieces 24, in which each game player receives a matching number of the game pieces 24. Each game piece 24 will match with one path 16 on the game board 12.

The home word bound board game 10 further contains a plurality of decks of game cards 26, each deck of game cards 26 will match with one path 16 on the game board 12. Each game card 26 has a word 28 to guess and a plurality of antonyms 30 and synonyms 32 for the word 28.

The home word bound board game further contains a plurality of game sheets 34, in which each game player receives one game sheet 34. Each game sheet 34 has areas 36 to keep track of the letters of the words 28, the antonyms 30, the synonyms 32, when the game piece 24 reaches the home space 22, the points received during the play of the game 10 for each path 16, total points received for each round of play and total points for all of the rounds of play of the game 10.

Each game sheet 34 includes a clear plastic coating 38 thereon, so that a marking pen 40 can be utilized to fill out the areas 36 on the sheet 34. The game sheet 34 can be reused by simply rubbing off the information filled in by the marking pen 40 on the clear plastic coating 38.

Each path 16 on each game board 12 is uniquely identifiable from the others by being coded in a color that is different from all other paths 16.

The game boards 12 are typically, but not limited to, four in number. The paths 16 on each game board 12 are typically, but not limited to, four in number. The numbered spaces 18 in each path 16 are typically, but not limited to, four in number. The number valve spaces 20 are typically, but not limited to, four in number. The home spaces 22 are typically, but not limited to, four in number. The colors for the paths 16 on each game board 12 are typically, but not limited to, yellow, red, blue and green.

The game pieces 24 are typically, but not limited to, sixteen in number, with four game pieces 24 being yellow in color, four game pieces 24 being red in color, four game pieces 24 being blue in color and four game pieces 24 being green in color. The decks of game cards 26 are typically, but not limited to, four in number and are yellow, red, blue and green in color.

The game sheets 34 are typically, but not limited to, four in number in which the areas 36 on each game sheet 34 are typically, but not limited to, be divided into four columns to keep track during the play of the game 10.

The marking pen 40 can be of any standard type of felt tip writing tool. A timer 42 can also be provided with the game 10, to time each player for a minute when guessing the word 28 on each game card 26.

RULES OF THE GAME

DEFINITIONS:

Antonyms—A word meaning the opposite of another.

Synonyms—A word having the same or nearly the same meaning as another word in the same language.

CONTENTS:

Four game boards, four game sheets, four marking pens, four decks of game cards (yellow, red blue and green) and sixteen game pieces (four being yellow red, blue and green).

OBJECTIVE:

To score as many points possible by guessing words using synonyms and antonyms.

SETUP:

Place the deck of game cards side by side in reach for everyone with the "HOME WORD BOUND" side facing up. Each player takes one game board, one game sheet, one marking pen and four game pieces. Each player places their game pieces on their game board in the center squares marked "START", with each piece going on its own color.

GAME PLAY:

1. Going First—Each player picks a game card and the closest word alphabetically to the letter "A" goes first. The cards then go back into the bottom of the deck and new game cards are used during game play.
2. On Your Turn—Declare the color path that you wish to play. The player on your right will then pick a game card of that color from the top of the deck. He will then tell you the first letter of the word and give you one synonym and one antonym as our clues. You then have one minute to guess the word.
3. Game Sheet—Write the first letter of the word on your game sheet in the area marked "WORD". Also write the synonym and the antonym in their correct areas. This is provided to keep track of clues as play proceeds. Make sure they are written in their correct color column.
4. Correct Answer—If the correct answer is given, multiply the number on the space under game piece you are playing by the value of that color which is indicated on its number value space. If for example you declare blue, then you must use your blue game piece on the blue spaces. If your piece is on the space numbered 4, then multiply 50 times 4. Then position your game piece in the home space, write 200 under blue points on your game sheet and check off "HOME" on your game sheet, in the proper color column. Play then continues with the next player.
5. Incorrect Answer—If an incorrect answer is given then move your game piece forward one space toward the home space. The game piece and space must be the same color you declared to play. Play then moves to the next player. Once play returns to you, the next letter in the word will be given along with a different synonym and antonym. If you guess correctly then see item 4 above; Correct Answer.
6. Clues—One letter, one antonym, and one synonym per turn is permitted. If a player is unable to guess after all clues have been given (four turns) he goes to the home space with zero points. Under no circumstances will all letters in a word be revealed to a player. If for example a three letter word is used and you are up to your third guess you will be given one synonym and one antonym only. A letter will not be given.
7. Round Play—A round is complete when all players have completed all four color paths. If one player has completed his round he cannot start another round until all the rest of the players have completed theirs. He should, however, continue giving clues. After all players have completed the round, they should total the points from each color path and then write that total in the upper right hand corner on their game sheet. The round obviously determines where in the upper right hand corner you write the total.
8. Winning The Game—After three rounds have been played, each player should total the scores from all three rounds in the upper right hand corner of the score sheet. The highest score wins.

LIST OF REFERENCE NUMBERS

10 home word bound board game
12 game board
14 center start space on 12
16 path on 12
18 numbered space in 16
20 number value space for 16
22 home space for 16
24 game piece
26 game card
28 word on 26
30 antonym on 26
32 synonym on 26
34 game sheet
36 area on 34
38 clear plastic coating
40 marking pen
42 timer It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A home word bound board game which comprises a plurality of game boards, one for each of a plurality of players, each said game board having a center start space with a plurality of paths extending from said center start space, each said path having indicia to make it uniquely identifiable from the others and having a plurality of descending consecutive numbered spaces form said center start space, said paths meet at said center start space of each board but neglect to touch each other, each path further having a space having a number value for said respective path and a home space, said game further including a plurality of game pieces, in which each game player receives a matching number of said game pieces, each said game pieces having said path indicia such that they will match with one said path on said game board, said game further including a plurality of decks of game cards, each said deck of game cards having said path indicia such that they match with one said paths on said game board, each said game card having a word to guess and a plurality of antonyms and synonyms for the word.

2. A home word bound board game as recited in claim 3, further including a plurality of game sheets, in which each game player receives one said game sheet, each said game sheet having areas to keep track of the letters of the words, the antonyms, the synonyms, when said game piece reaches said home space, the points received during the play of the game for each said path, total points received for each round of play and total points for all of the rounds of play of the game.

3. A home word bound board game as recited in claim 2, wherein each said game sheet includes a clear plastic coating thereon, so that a marking pen can be utilized to fill out the areas on said game sheet, so that said game sheet can be reused by simply rubbing off the information filled in by the marking pen on said clear plastic coating.

4. A home word bound board game as recited in claim 3, wherein said indicia on each said path on each said game board is uniquely identifiable from the others by being coded in a color that is different from all other said paths.

5. A home word bound, board game as recited in claim 4, wherein said game boards are typically, but not limited to, four in number, said paths on each said game board are typically, but not limited to, four in number, said numbered spaces in each said path are typically, but not limited to, four in number, said number value spaces are typically, but not limited to, four in number and said home spaces are typically, but not limited to, four in number.

6. A home word bound board game as recited in claim 5, wherein said colors for said paths on each said game board are typically, but not limited to, yellow, red, blue and green.

7. A home word bound board game as recited in claim 6, wherein said game pieces are typically, but not limited to, sixteen in number, with four said game pieces being yellow in color, four said game pieces being red in color, four said game pieces being blue in color and four said game pieces being green in color.

8. A home word bound board game as recited in claim 7, wherein said decks of game cards are typically, but not limited to, four in number and are yellow, red, blue and green in color.

9. A home word bound board game as recited in claim 8, wherein said game sheets are typically, but not limited to, four in number, in which the areas on each said game sheet are typically, but not limited to, be divided into four columns to keep track during the play of the game.

10. A home word bound game as recited in claim 9, wherein each of said plurality of pieces is round and have a thickness.

11. A home word bound game as recited in claim 10, wherein each game board has four different colored paths.

12. A home word bound game as recited in claim 11, wherein each of said game boards have the same four different colored paths.

13. A home word bound game as recited in claim 12, wherein said game sheet contains categories for at least words, antonyms, synonyms, and total points.

* * * * *